US011091939B2

(12) United States Patent
Enomoto

(10) Patent No.: US 11,091,939 B2
(45) Date of Patent: Aug. 17, 2021

(54) DOOR LOCK APPARATUS

(71) Applicant: MITSUI KINZOKU ACT CORPORATION, Yokohama (JP)

(72) Inventor: Daisuke Enomoto, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 596 days.

(21) Appl. No.: 15/792,118

(22) Filed: Oct. 24, 2017

(65) Prior Publication Data

US 2018/0112442 A1 Apr. 26, 2018

(30) Foreign Application Priority Data

Oct. 25, 2016 (JP) ..... JP2016-208911

(51) Int. Cl.

| | |
|---|---|
| ***E05B 77/26*** | (2014.01) |
| ***E05B 79/20*** | (2014.01) |
| *E05B 81/06* | (2014.01) |
| *E05B 81/16* | (2014.01) |

(52) U.S. Cl.

CPC ..... *E05B 77/265* (2013.01); *E05B 79/20* (2013.01); *E05B 81/06* (2013.01); *E05B 81/16* (2013.01)

(58) Field of Classification Search

None

See application file for complete search history.

(56) References Cited

U.S. PATENT DOCUMENTS

| | | | | |
|---|---|---|---|---|
| 4,969,673 | A * | 11/1990 | Portelli | E05B 77/265 292/216 |
| 5,762,383 | A * | 6/1998 | Gomi | E05B 77/26 292/216 |
| 8,684,425 | B2 * | 4/2014 | Nagaoka | E05B 77/265 292/201 |
| 2002/0050720 | A1 | 5/2002 | Helmer | |
| 2004/0227359 | A1 | 11/2004 | Coleman et al. | |

(Continued)

FOREIGN PATENT DOCUMENTS

| | | | |
|---|---|---|---|
| CN | 1550629 | A | 12/2004 |
| CN | 101802330 | A | 8/2010 |

(Continued)

OTHER PUBLICATIONS

Chinese Office Action dated Mar. 15, 2019 in corresponding application No. 201710985135X.

(Continued)

*Primary Examiner* — Alyson M Merlino

(74) *Attorney, Agent, or Firm* — Foley & Lardner LLP

(57) ABSTRACT

A door lock apparatus includes an inside lever, an opening member for switching a latch mechanism to an unlatching state by a rotation of the inside lever, a child lever translated between set and unset positions; and a bush translated together with the child lever. The bush engages with the inside lever and transmits the rotation of the inside lever to the opening member when the child lever is disposed in the unset position and is released from the engagement with the inside lever when the child lever is disposed in the set position. A movable range of the child lever and the bush is confined inside a circle centered at a rotation shaft of the inside lever and whose radius corresponds to a distance from the rotation shaft to a farthest point of the inside lever.

9 Claims, 18 Drawing Sheets

(56) References Cited

U.S. PATENT DOCUMENTS

| | | | |
|---|---|---|---|
| 2006/0186675 | A1 | 8/2006 | Suzumura et al. |
| 2007/0029815 | A1 | 2/2007 | Coleman et al. |
| 2008/0023971 | A1 | 1/2008 | Akizuki et al. |
| 2009/0090142 | A1 | 4/2009 | Thomson et al. |
| 2010/0171321 | A1 | 7/2010 | Akizuki et al. |
| 2010/0327609 | A1 | 12/2010 | Akizuki et al. |
| 2015/0284977 | A1 | 10/2015 | Barmscheidt |
| 2016/0215531 | A1 | 7/2016 | Hirosawa |

FOREIGN PATENT DOCUMENTS

| | | | | |
|---|---|---|---|---|
| CN | 101960082 | A | 1/2011 | |
| CN | 104937198 | A | 9/2015 | |
| CN | 105525803 | A | 4/2016 | |
| CN | 105735780 | A | 7/2016 | |
| CN | 105822152 | A | 8/2016 | |
| DE | 4108507 | A1 * | 9/1992 | ..... E05B 77/26 |
| FR | 2798692 | A1 | 3/2001 | |
| GB | 2457778 | A * | 9/2009 | ..... E05B 77/265 |
| JP | 01-086665 | | 6/1989 | |
| JP | 2006-233456 | | 9/2006 | |
| JP | 4342502 | B2 | 10/2009 | |
| JP | 2011-132713 | A | 7/2011 | |
| JP | 2012-154138 | | 8/2012 | |
| KR | 101513000 | B1 | 4/2015 | |
| WO | WO-95/13445 | A1 | 5/1995 | |

OTHER PUBLICATIONS

Japanese Office Action dated Oct. 15, 2019 for corresponding Application No. 2016-208911.

* cited by examiner

DOOR LOCK APPARATUS

This application claims priority from Japanese Patent Application No. 2016-208911, filed on Oct. 25, 2016, the entire subject-matter of which is incorporated herein by reference.

TECHNICAL FIELD

The present disclosure relates to a door lock apparatus that is provided on a door of a vehicle such as a motor vehicle.

BACKGROUND

As a door lock apparatus that is provided on a door of a vehicle such as a motor vehicle, there is known a door lock apparatus that includes a child-proof system configured to prevent a rear door of the vehicle from being opened even when an inside handle of the rear door is operated to open the rear door by, for example, a child on a rear seat (for example, refer to Japanese Patent No. 4342502).

The door lock apparatus described in Japanese Patent No. 4342502 includes an inside lever that is rotated in response to a door opening operation performed on the inside handle and an opening member that can move in a door unlatching direction in which a latching state of a door lock is released when the rotation of the inside lever is transmitted thereto. Then, the child-proof system includes a child protector member that can be switched between a set position and an unset position and a movable operator that is supported on the child protector member so as to rotate along an arc-shaped guiding plane that is provided on the child protector member.

When the child protector member is at the unset position, the movable operator is brought into engagement with the rotated inside lever to thereby be pressed against and is then rotated along the arc-shaped guiding plane on the child protector member. Then, the rotation of the inside lever is transmitted to the opening member via the rotation of the movable operator, whereby the latching state of the door lock is released. On the other hand, when the child protector member is at the set position, the engagement of the movable operator with the inside lever is released. Because of this, the rotation of the inside lever is not transmitted to the opening member, whereby the rear door of the vehicle is prevented from being opened even though the inside handle is operated to open the rear door.

In the door lock apparatus described in Japanese Patent No. 4342502, when the child protector member is moved from the unset position to the set position, the movable operator is moved away from a rotation shaft of the inside lever. A movable range of the inside lever and the movable operator is centered at the rotation shaft of the inside lever and expands to an outside of a circle having a radius corresponding to a distance from the rotation shaft to a farthest point of the inside lever, resulting in fears that the movable range expanding to such an extent prevents a reduction in size and weight of the door lock apparatus.

SUMMARY

Illustrative aspect of the disclosure provides a door lock apparatus that can be reduced in size and weight.

According to one illustrative aspect of the disclosure, there is provided a door lock apparatus comprising: a latch mechanism configured to be switched between a latching state, in which the latch mechanism is brought into engagement with a striker provided on a vehicle body to hold a vehicle door in a closed state, and an unlatching state; an inside lever configured to be rotated in response to an operation of an inside handle of the vehicle door to open the vehicle door; an opening member configured to switch the latch mechanism to the unlatching state by being transmitted with a rotation of the inside lever; a child lever, which comprises an operating portion that is exposed through a hole formed in a panel of the vehicle door, and which is configured to be translated between a set position and an unset position in response to an operation of the operating portion; and a bush configured to be translated together with the child lever, wherein when the child lever is disposed in the unset position, the bush is brought into engagement with the inside lever that is rotated and then transmits the rotation of the inside lever to the opening member, whereas when the child lever is disposed in the set position, the bush is released from the engagement with the inside lever, and wherein a movable range of the child lever and the bush is confined inside a circle that is centered at a rotation shaft of the inside lever and whose radius corresponds to a distance from the rotation shaft to a farthest reaching point of the inside lever.

According to the disclosure, it is possible to provide the door lock apparatus that can be reduced in size and weight.

DETAILED DESCRIPTION

Figure 1:
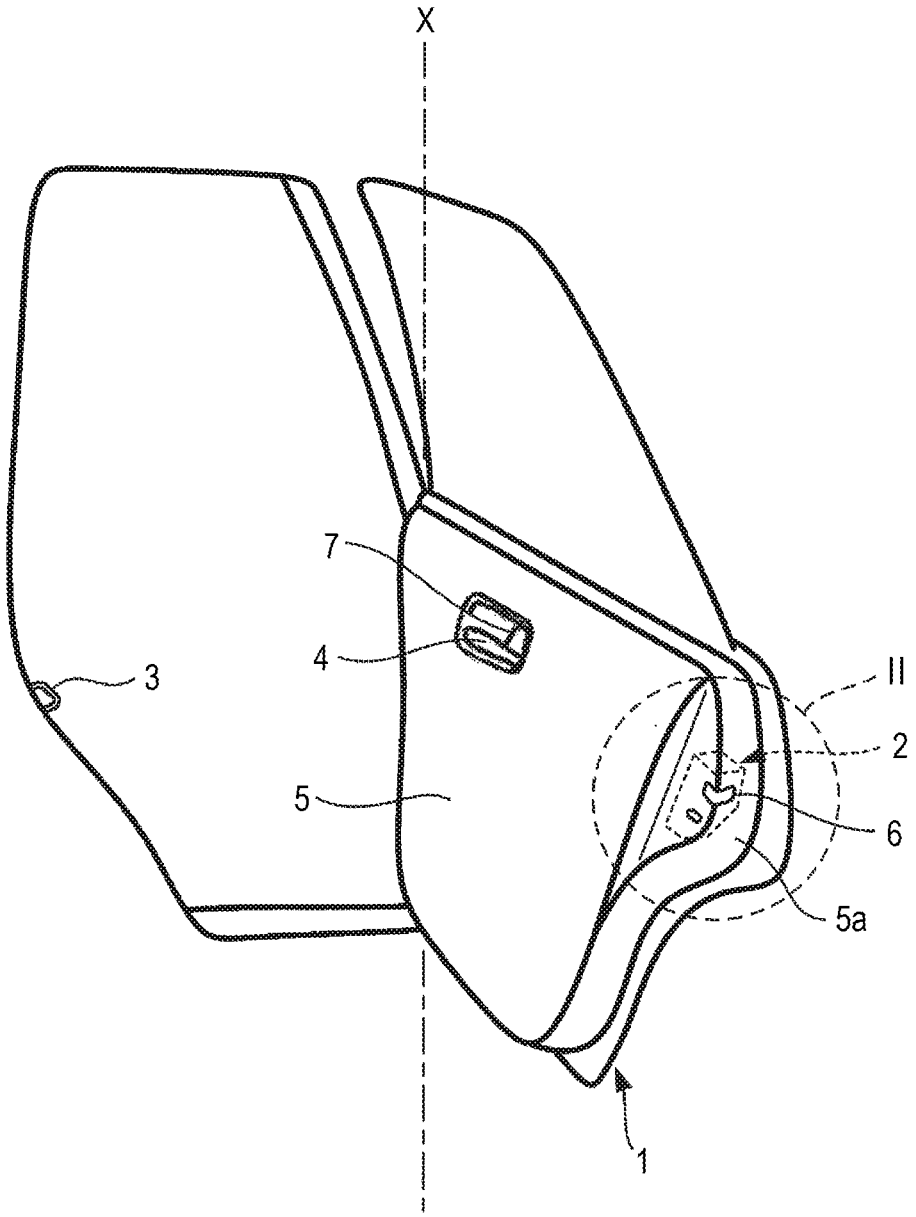
FIG. 1 is a perspective view of an example of a vehicle on which a door lock apparatus according to an illustrative embodiment of the disclosure is mounted.

FIG. 1 shows an example of a vehicle on which a door lock apparatus according to an illustrative embodiment of the disclosure is mounted.

Figure 2:
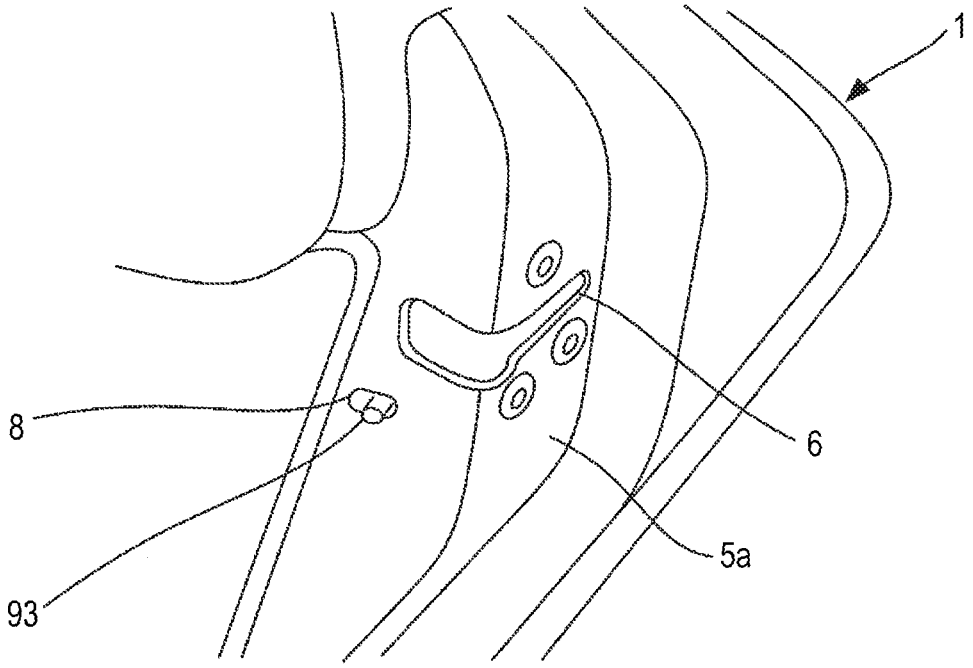
FIG. 2 is an enlarged view of a portion that is surrounded by a circle II drawn by a broken line in FIG. 1.

A vehicle shown in FIGS. 1 and 2 include a vehicle door 1 on which a door lock apparatus 2 is provided. The vehicle door 1 is turned or rotated about a rotation axis X that extends in an up-down direction of the vehicle at a door's front-end side thereof in a front-rear direction of the vehicle so as to be opened in a width direction of the vehicle.

The door lock apparatus 2 includes a latch mechanism and an opening member.

The latch mechanism can be switched between a latching state where the latch mechanism is brought into engagement with a striker 3 provided on a vehicle body to fasten the vehicle door 1 in a closed state and an unlatching state where the latch mechanism is disengaged from the striker 3 so as to allow the vehicle door 1 to be opened.

The opening member executes an unlatching operation when the inside handle 4 or an outside handle (not shown) of the vehicle door 1 is operated to open the vehicle door 1 so as to switch the latch mechanism from the latching state to the unlatching state.

A cutout 6 is formed in a door's rear-end side end face 5*a* of an inner panel 5 of the vehicle door 1 so as to extend in a direction in which the striker 3 enters the latch mechanism. The door lock apparatus 2 is attached to the door's rear-end side end face 5*a* of the inner panel 5 with a fastening tool such as a bolt.

The door lock apparatus 2 includes further a locking and unlocking mechanism and a child-proof mechanism.

The locking and unlocking mechanism can be switched between a locking state where the locking and unlocking mechanism nullifies an unlatching operation of the opening member that is triggered by operating the inside handle 4 or the outside handle so as to prevent the latch mechanism from being switched to the unlatching state and an unlocking state. The locking and unlocking mechanism is switched between the locking state and the unlocking state by operating an operation of a lock knob 7 on the vehicle door 1 or a control switch (not shown) provided in a position near a driver's seat of the vehicle so as to put the locking and unlocking mechanism in the locking or unlocking state.

The child-proof mechanism can be switched between a set state, in which the child-proof mechanism prevents an unlatching operation of the opening member that is triggered by operating the inside handle 4 to thereby prevent the latch mechanism from being switched to the unlatching state, and an unset state. The child-proof mechanism is switched between the set state and the unset state by operating a control portion 93 of the child-proof mechanism that is exposed through a hole 8 formed in the inner panel 5.

Figure 3:
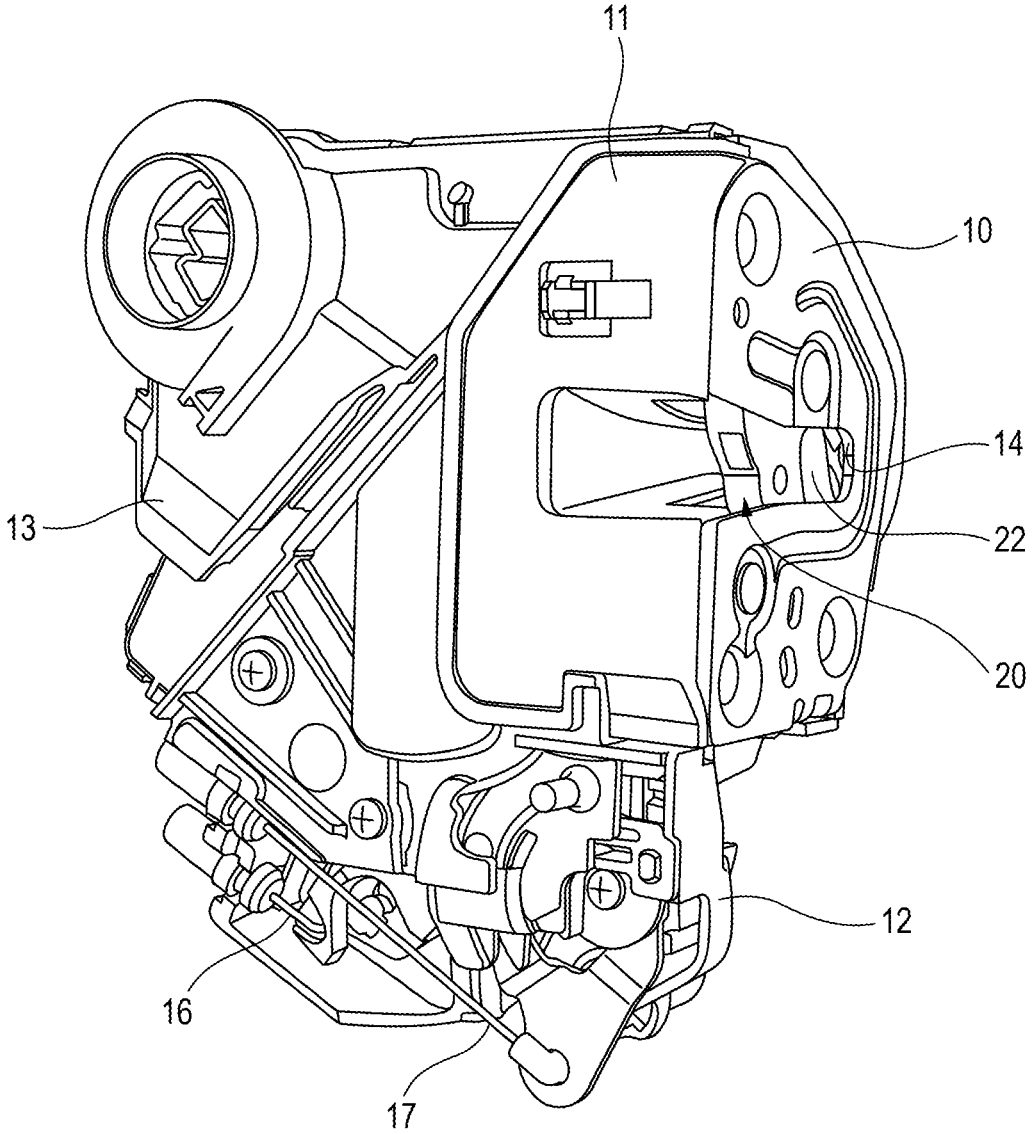
FIG. 3 is a perspective view of the door lock apparatus that is provided on a vehicle door in FIG. 1.

FIG. 3 shows an external appearance of the door lock apparatus 2.

The door lock apparatus 2 is made up by assembling various members that make up the latch mechanism, the locking and unlocking mechanism and the child-proof mechanism and the opening member onto a metallic cover plate 10 that is attached to the door's rear-end side end face 5*a* (hereinafter, referred to as a door lock attaching surface) of the inner panel 5 of the vehicle door 1 and a body 11, a case 12 and a cover 13 that are formed of a resin and which are assembled to the cover plate 10. A striker entering groove 14 is formed in the cover plate 10 so as to be disposed to overlap the cutout 6 formed in the inner panel 5 (refer to FIGS. 1 and 2), and when the vehicle door 1 is closed, the striker 3 enters the striker entering groove 14.

Hereinafter, the latch mechanism, the opening member, the locking and unlocking mechanism and the child-proof mechanism of the door lock apparatus 2 will be described sequentially.

Figure 4:
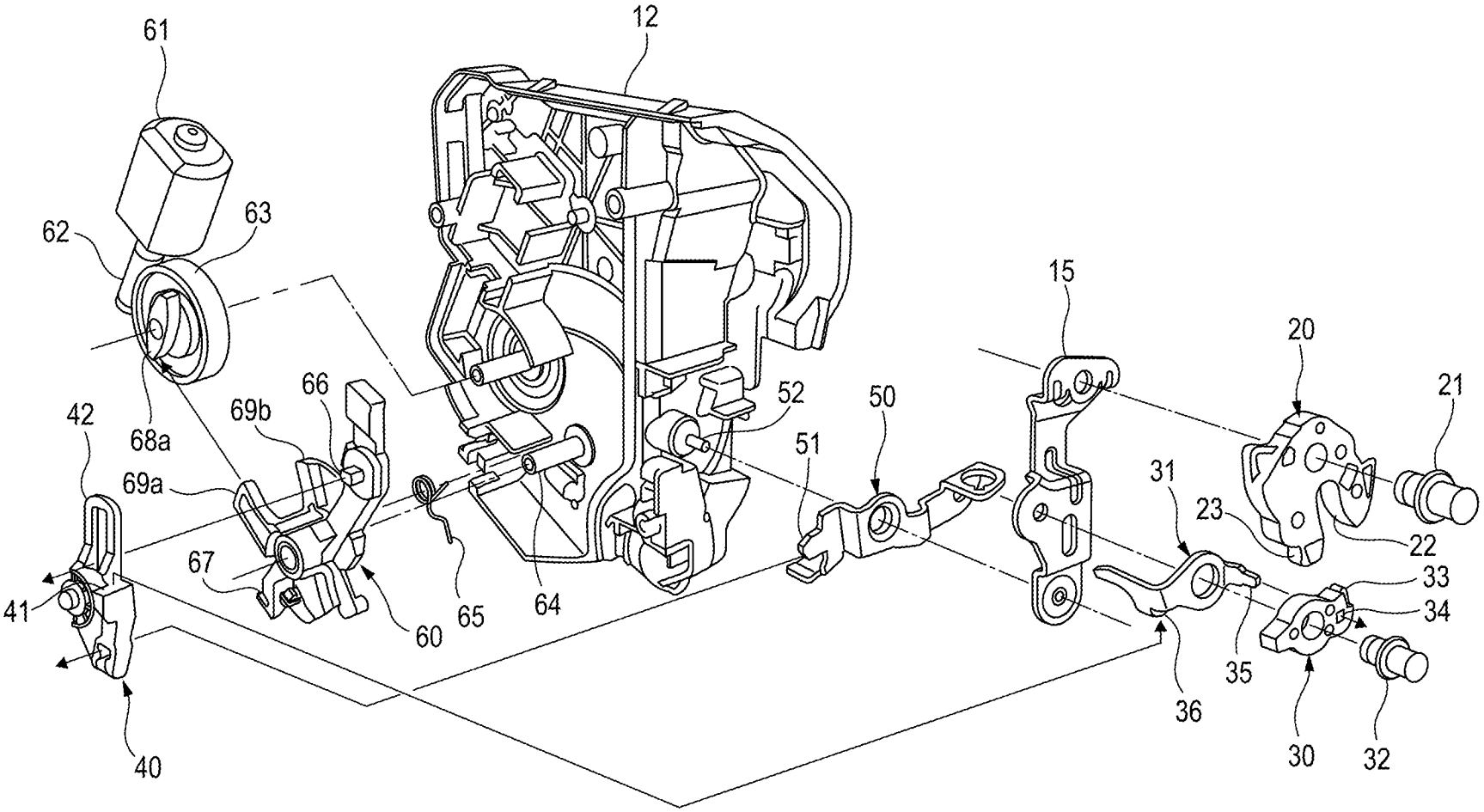
FIG. 4 is an exploded perspective view of the door lock apparatus shown in FIG. 3, showing the door lock apparatus that is disassembled into a latch mechanism, an opening member and a locking and unlocking mechanism.

FIG. 4 shows the configurations of the latch mechanism, the opening member and the locking and unlocking mechanism.

The latch mechanism includes a latch 20, a ratchet 30 and a ratchet lever 31.

The latch 20 is supported rotatably by a latch shaft 21. The ratchet 30 and the ratchet lever 31 are supported rotatably by a ratchet shaft 32. The latch shaft 21 and the ratchet shaft 32 are supported by a back plate 15 that is fixed to the case 12.

The latch 20 has a striker engaging groove 22 configured to engage with the striker 3. The latch 20 is configured to be rotatable between releasing position (refer to FIG. 5) where an entrance of the striker engaging groove 22 is disposed to overlap the striker entering groove 14 in the cover plate 10 and a full latching position (refer to FIG. 6) where the entrance of the striker engaging groove 22 is disposed to be out of alignment with the striker entering groove 14.

The ratchet 30 has a locking portion 33 that can be brought into engagement with a full latching engaging portion 23. The full latching engaging portion 23 is provided on an outer circumferential portion of the latch 20. The ratchet lever 31 has an engaging projection 35 that is brought into engagement with an engaging hole 34 formed in the ratchet 30. The ratchet lever 31 rotates together with the ratchet 30 by engagement of the engaging projection 35 with the engaging hole 34.

An opening member 40 is supported by a supporting portion 51 that is provided at an end of an outside lever 50. The outside lever 50 is supported rotatably by an outside lever shaft 52 that is provided on the case 12. The outside lever 50 is connected to the outside handle by way of a cable (not shown) and is rotated in response to an operation of the outside handle, whereby the opening member 40 is moved upwards in response to the rotation of the outside lever 50.

The opening member 40 has a pressing portion 41 that is disposed so as to be opposite to a lower portion of a pressed portion 36 that is provided on the ratchet lever 31. When the opening member 40 is moved upwards in response to the rotation of the outside lever 50, the pressing portion 41 is brought into abutment with the lower portion of the pressed portion 36 to thereby push up the pressed portion 36.

Figure 5:
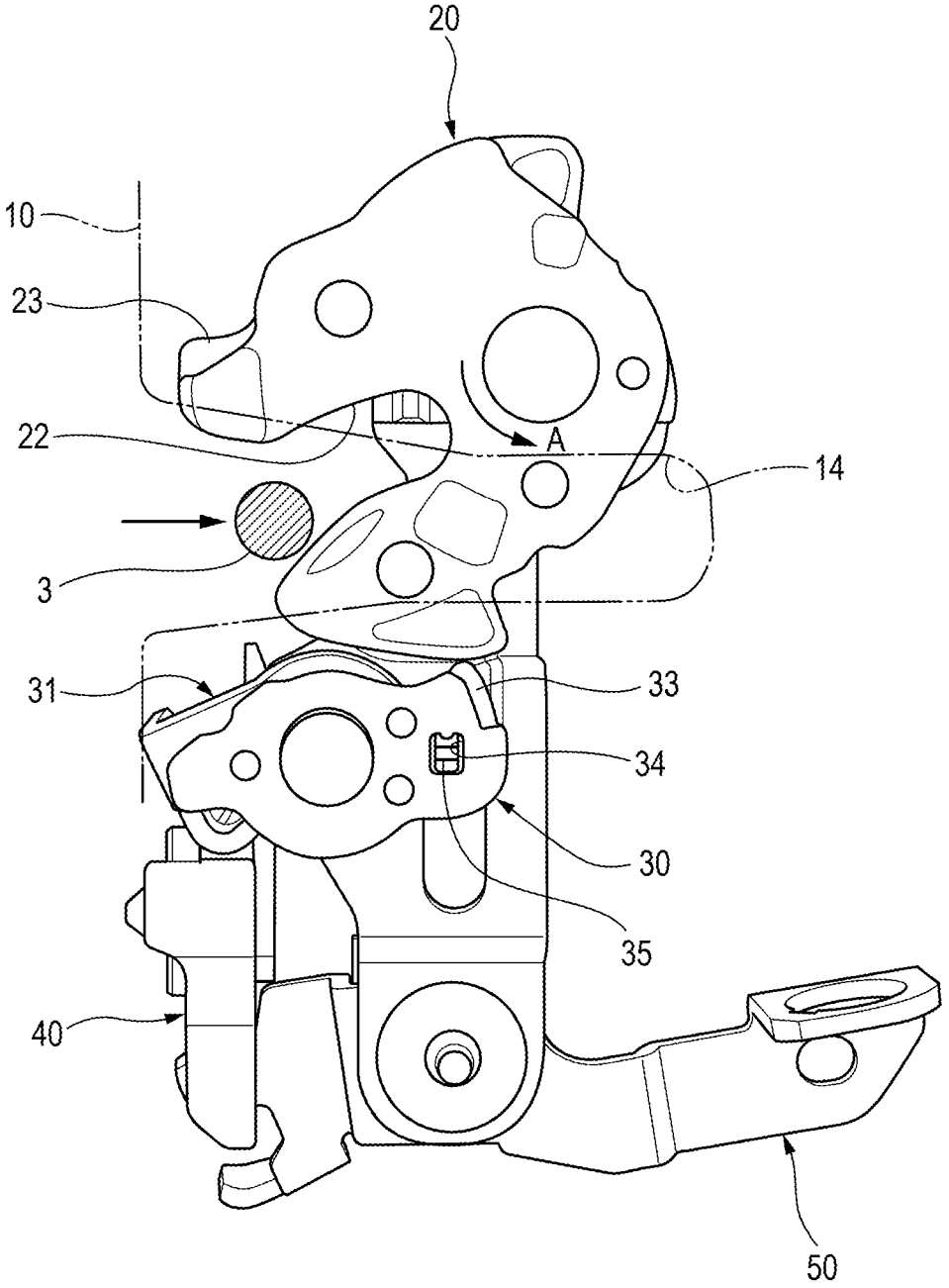
FIG. 5 is a schematic view showing an operation of the latch mechanism shown in FIG. 4.
Figure 6:
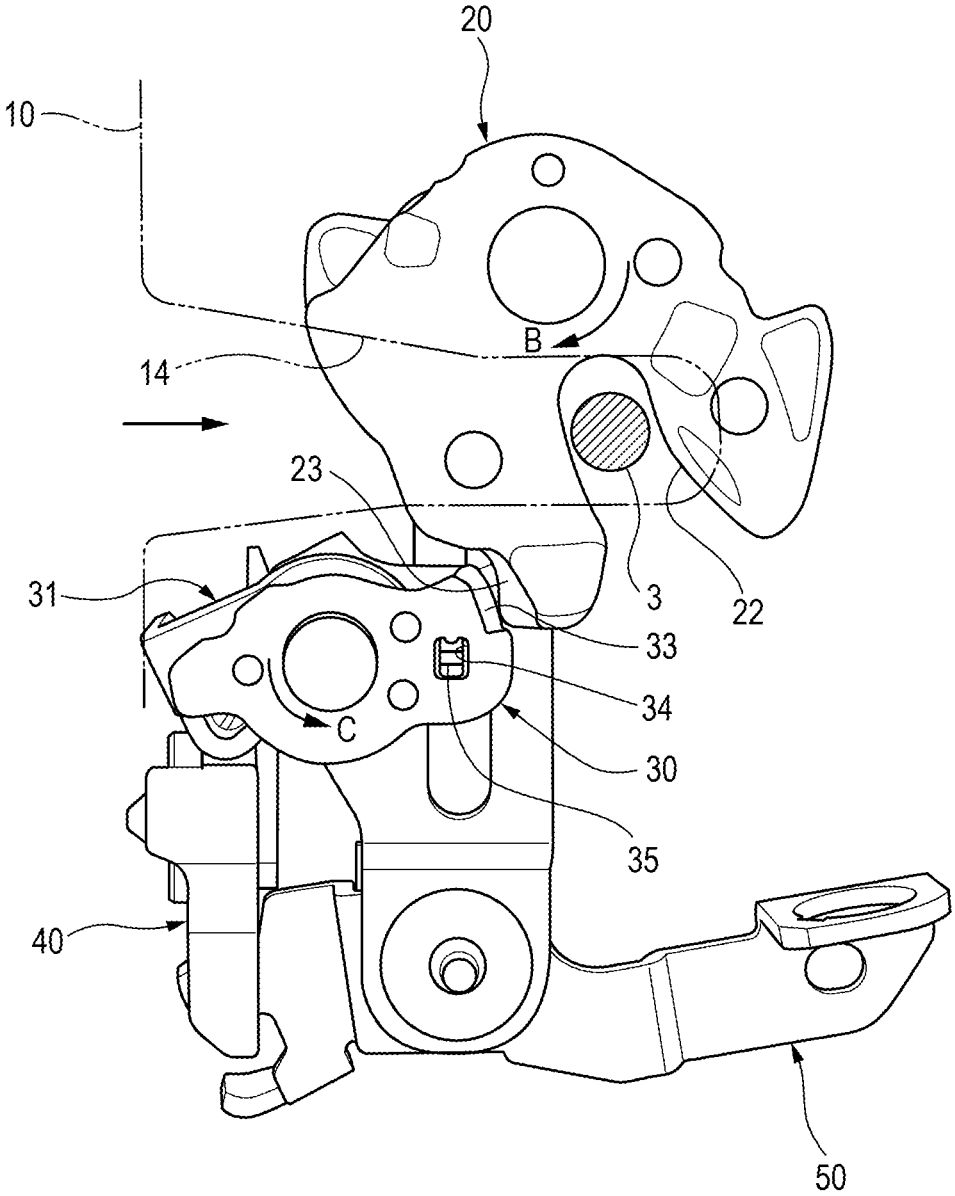
FIG. 6 is a schematic view showing another operation of the latch mechanism shown in FIG. 4.
Figure 7:
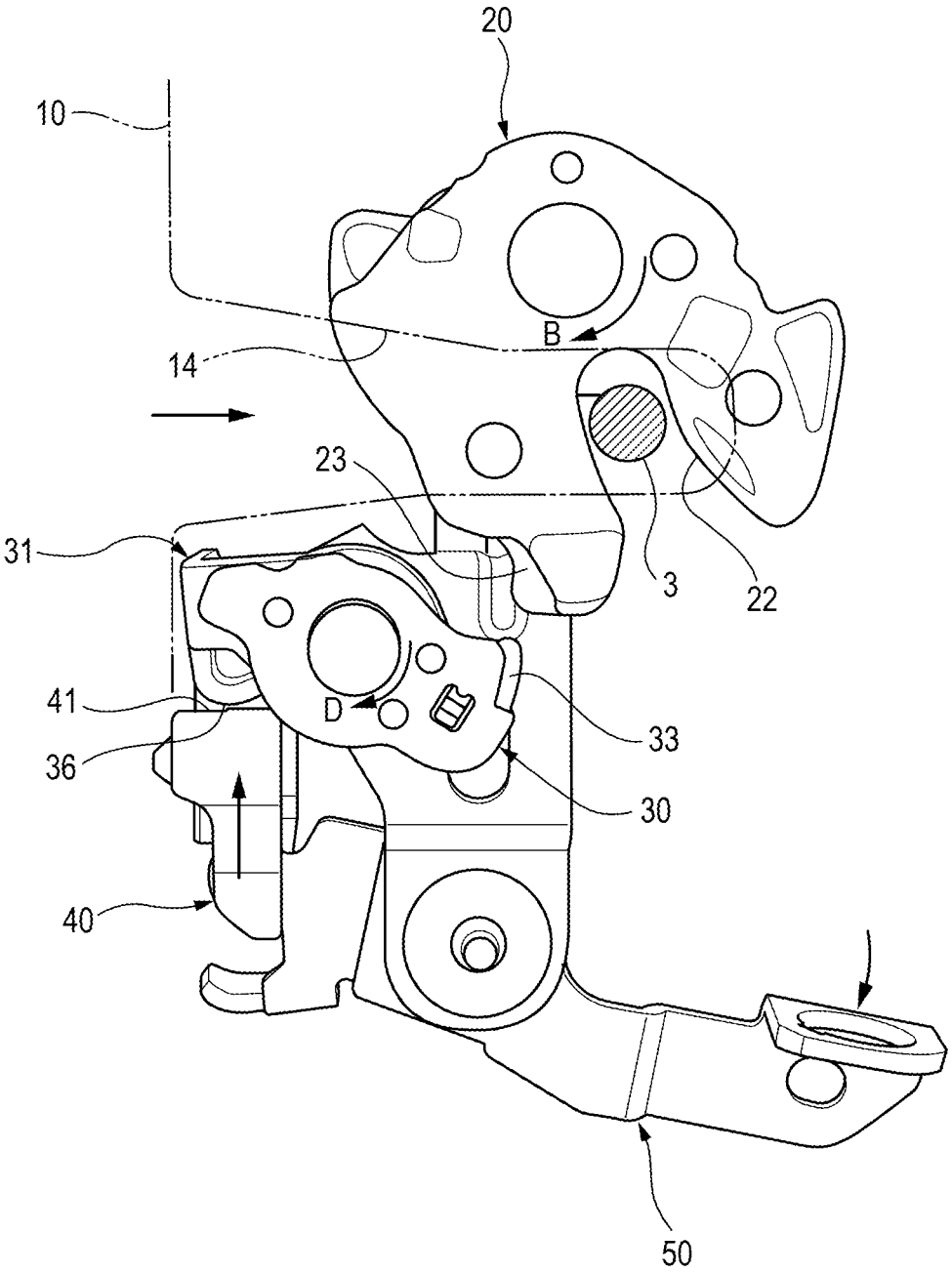
FIG. 7 is a schematic view showing a further operation of the latch mechanism shown in FIG. 4.

FIGS. 5 to 7 show operations of the latch mechanism. Incidentally, it is assumed that the vehicle door 1 is open.

As shown in FIG. 5, the striker 3 enters the striker entering groove 14 in the cover plate 10 as the vehicle door 1 is closed and is then received in the striker engaging groove 22 in the latch 20 that is situated in the releasing position. The latch 20 is pressed against by the striker 3 that is in abutment with a side surface of the striker engaging groove 22 to thereby be rotated in a direction indicated by an arrow A in FIG. 5 from the releasing position towards the full latching position.

FIG. 6 shows the latch mechanism that is situated in the latching state. The full latching engaging portion 23 of the latch 20 is in engagement with the locking portion 33 of the ratchet 30, and the full latching engaging portion 23 and the locking portion 33 are kept in engagement with each other by the ratchet 30 being biased in a direction indicated by an arrow C in FIG. 6 by a torsion spring (not shown). This prevents the latch 20 from rotating in a direction indicated by an arrow B in FIG. 6 towards the releasing position, whereby the vehicle door 1 is held in the closed state.

FIG. 7 shows the latch mechanism that is switched to the unlatching state. When the outside lever 50 is rotated in response to an operation of the outside handle, the opening member 40 is moved upwards, and the pressed portion 36 of the ratchet lever 31 is pushed up by the pressing portion 41 of the opening member 40 that is moved upwards.

Then, as a result of the pressed portion 36 being pushed up, the ratchet 30 and the ratchet lever 31 are rotated in a direction indicated by an arrow D in FIG. 7 against the torsion spring to thereby release the engagement between the full latching engaging portion 23 and the locking portion 33. This enables the latch 20 to rotate in a direction indicated by an arrow B in FIG. 7 towards the releasing position, allowing the striker 3 to leave from the striker entering groove 14, whereby the vehicle door 1 can be opened.

Referring again to FIG. 4, the locking and unlocking mechanism will be described.

The locking and unlocking mechanism includes a lock lever 60, a motor 61, a worm gear 62 and a worm wheel 63.

The lock lever 60 is supported rotatably by a lock lever shaft 64 that is provided on the case 12. The lock lever 60 is rotated between an unlocking position (refer to FIG. 8) where an unlatching operation of the opening member 40 to push up the pressed portion 36 of the ratchet lever 31 is effected to switch the latch mechanism to the unlatching state and a locking position (refer to FIG. 9) where the unlatching operation of the opening member 40 is nullified. Then, the lock lever 60 is held in the unlocking position and the locking position by a toggle spring 65 that reverses its biasing direction as the lock lever 60 rotates.

The lock lever 60 has an engaging projection 66 that is brought into engagement with an engaging frame 42 that is provided on the opening member 40. The engaging frame 42 extends in the up-down direction. The engaging projection 66 is in engagement with the engaging frame 42 so as to slide relatively on an inner edge of the engaging frame 42 in a direction in which the engaging frame 42 extends when the opening member 40 is moved upwards in response to the rotation of the outside lever 50.

The opening member 40 is supported rotatably by the supporting portion 51 of the outside lever 50. The opening member 40 is configured to oscillate by being pushed and pulled by the engaging projection 66 of the lock lever 60 in response to the rotation of the lock lever 60. When the lock lever 60 is disposed in the unlocking position, the pressing portion 41 of the opening member 40 is disposed so as to be opposite to the lower portion of the pressed portion 36 of the ratchet lever 31, whereas when the lock lever 60 is disposed in the locking position, the pressing portion 41 is disposed so as to be out of alignment with the position where the pressing portion 41 lies opposite to the lower portion of the pressed portion 36.

The lock lever 60 is connected to the lock knob 7 (refer to FIG. 1) of the vehicle door 1 by way of a cable 16 (refer to FIG. 8) that is connected to a cable connecting portion 67. The lock lever 60 is rotated based on an operation of the lock knob 7 to lock or unlock the vehicle door 1. Additionally, the lock lever 60 is in engagement with the worm wheel 63, whereby the lock lever 60 is also rotated, for example, when the motor 61 is driven based on an operation of the control switch provided near the driver's seat of the vehicle to lock or unlock the vehicle door 1, rotating the worm wheel 63 by way of the worm gear 62.

Figure 8:
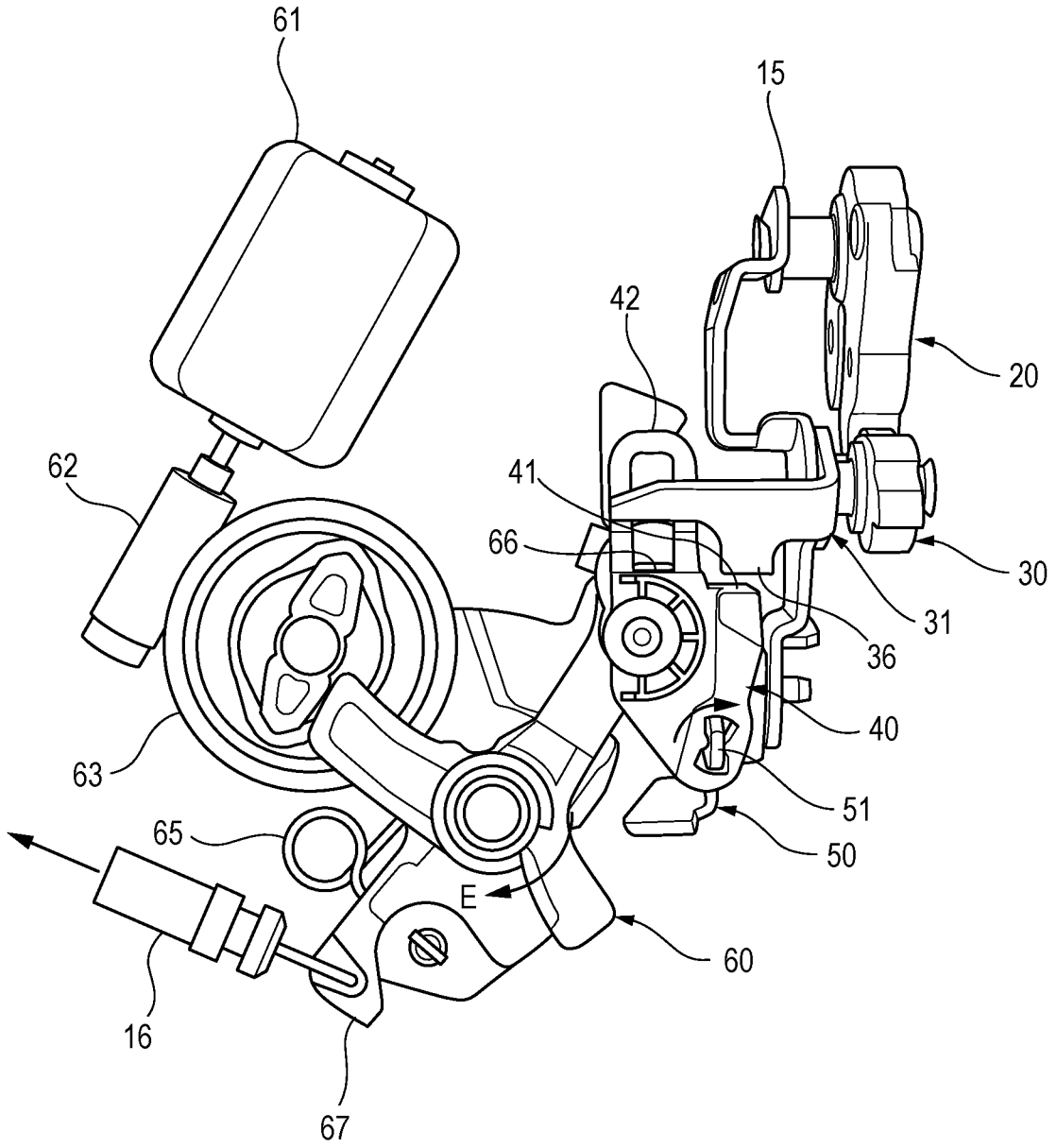
FIG. 8 is a schematic view showing an operation of the locking and unlocking mechanism shown in FIG. 4.
Figure 9:
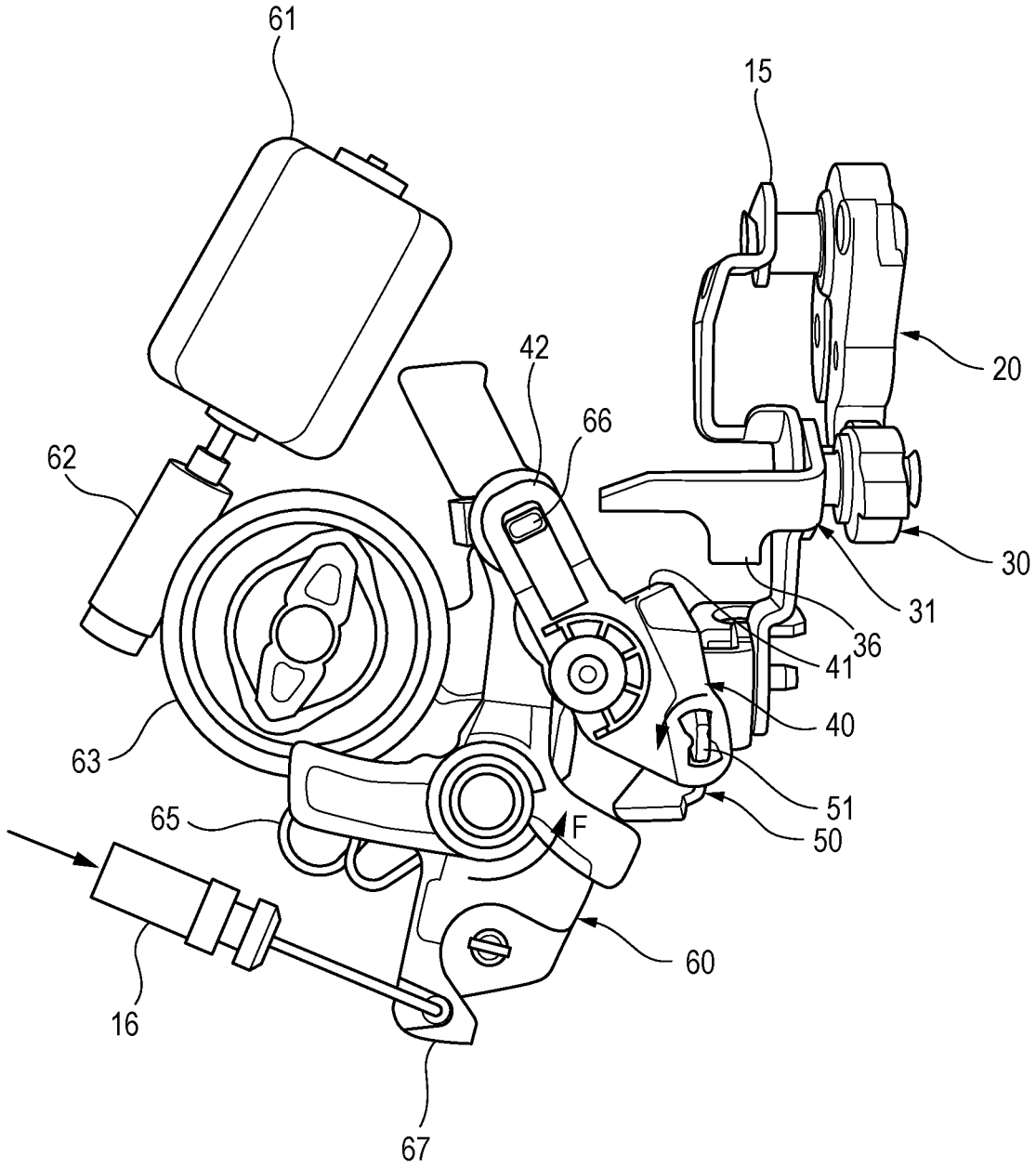
FIG. 9 is a schematic view showing another operation of the locking and unlocking mechanism shown in FIG. 4.

FIGS. 8 and 9 show operations of the locking and unlocking mechanism resulting when the lock lever 60 is rotated based on an operation of the lock knob 7 to lock or unlock the vehicle door 1.

FIG. 8 shows the locking and unlocking mechanism situated in the unlocking state. When the lock knob 7 is operated to unlock the vehicle door 1, causing the cable 16 to be pulled, the lock lever 60 is rotated in a direction indicated by an arrow E in FIG. 8 towards the unlocking position. Then, the opening member 40 is also caused to oscillate in response to the rotation of the lock lever 60, and with the lock lever 60 disposed in the unlocking position, the pressing portion 41 of the opening member 40 is disposed so as to be opposite to the lower portion of the pressed portion 36 of the ratchet lever 31.

When the outside handle is operated to open the vehicle door 1 with the lock lever 60 disposed in the unlocking position, as shown in FIG. 7, the opening member 40 operates to unlatch the vehicle door 1 by pushing up the pressed portion 36, whereby the latch mechanism is switched from the latching state to the unlatching state.

FIG. 9 shows the locking and unlocking mechanism situated in the locking state. When the lock knob 7 is operated to lock the vehicle door 1 by the cable 16 being pulled, the lock lever 60 is rotated in a direction indicated by an arrow F in FIG. 9 towards the locking position. With the lock lever 60 disposed in the locking position, the pressing portion 41 of the opening member 40 is disposed out of alignment with the position where the pressing portion 41 lies opposite to the lower portion of the pressed portion 36 of the ratchet lever 31.

When the outside handle is operated to open the vehicle door 1 with the lock lever 60 disposed in the locking position, although the opening member 40 is moved upwards, the pressing portion 41 swings idly without being brought into abutment with the pressed portion 36. This nullifies the unlatching operation of the opening member 40 in which the pressed portion 36 is pushed up, whereby the latch mechanism is held in the latching state.

Figure 10:
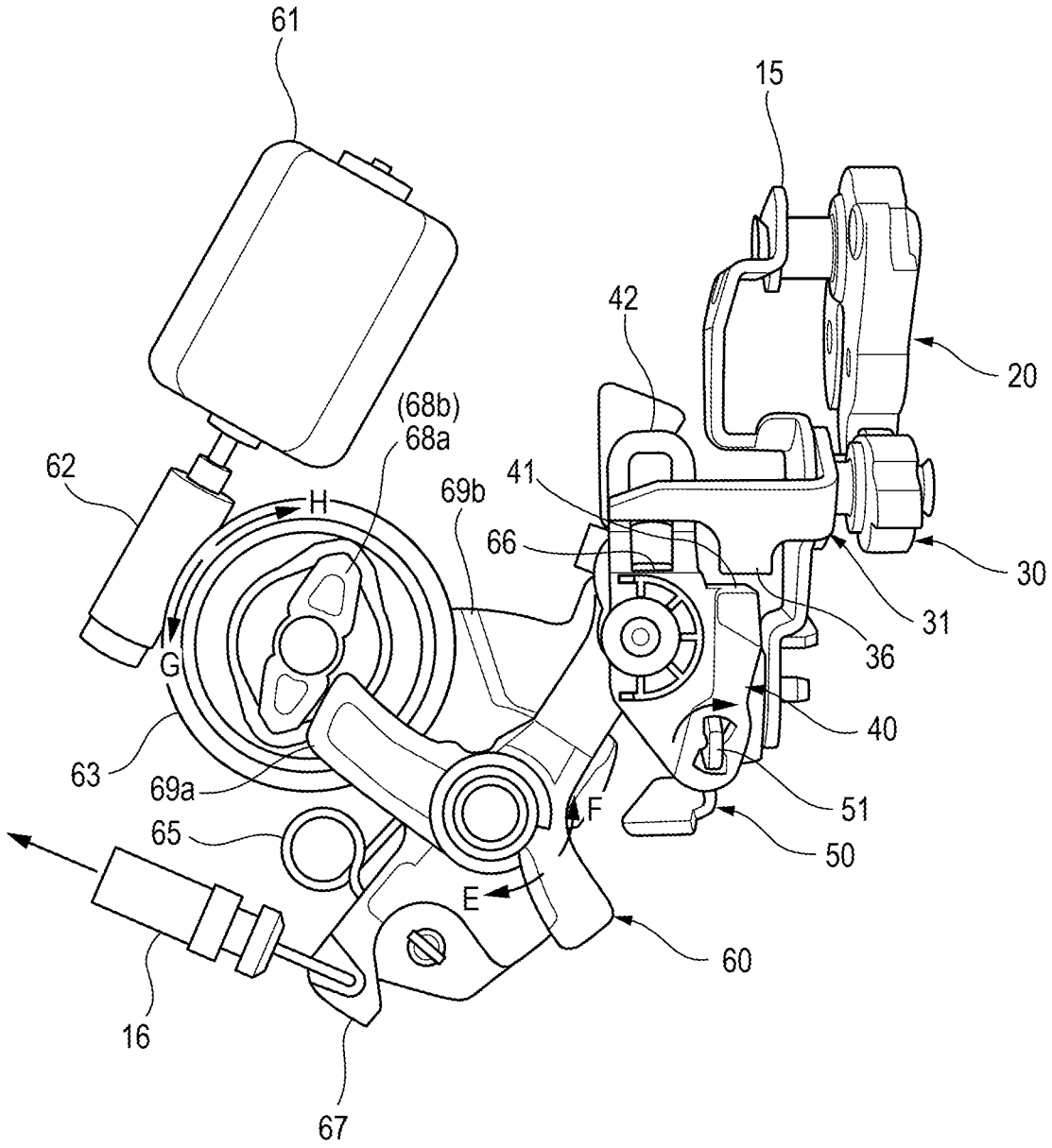
FIG. 10 is a schematic view showing a further operation of the locking and unlocking mechanism shown in FIG. 4.

FIG. 10 shows an operation of the locking and unlocking mechanism resulting when the lock lever 60 is rotated based on an operation of the control switch of the motor 61 to lock or unlock the vehicle door 1.

The lock lever 60 has cam followers 69*a*, 69*b* that are brought into engagement with cams 68*a*, 68*b*, respectively, that are provided on both side surfaces of the worm wheel 63 so as to project therefrom. When the control switch is operated to unlock the vehicle door 1 and the worm wheel 63 is rotated in a direction indicated by an arrow G in FIG. 10, the cam 68*b* and the cam follower 69*b* are brought into engagement with each other, and hence, the lock lever 60 is rotated in a direction indicated by an arrow E in FIG. 10 towards the unlocking position of the lock lever 60. In addition, when the control switch is operated to lock the vehicle door 1 and the worm wheel 63 is rotated in a direction indicated by an arrow H in FIG. 10, the cam 68*a* and the cam follower 69*a* are brought into engagement with each other, and the lock lever 60 is rotated in the direction indicated by an arrow F in FIG. 10 towards the locking position.

Here, in a case where an operation of the lock knob 7 or the control switch of the motor 61 to unlock the vehicle door 1 and an operation of the outside handle to open the vehicle door 1 are carried out almost at the same time, the opening member 40 is moved upwards before the pressing portion 41 of the opening member 40 is disposed so as to be opposite to the lower portion of the pressed portion 36 of the ratchet lever 31, thereby generating a so-called panic state where the pressing portion 41 that swings idly is brought into abutment with a side portion of the pressed portion 36 of the ratchet lever 31.

In a case where the panic state is generated, the operation of the outside handle to open the vehicle door 1 is suspended once and the opening member 40 is moved downwards, whereby the pressing portion 41 can be disposed so as to be opposite to the lower portion of the pressed portion 36. However, as this occurs, in order to obviate the necessity of executing another unlocking operation on the lock knob 7, the lock lever 60 includes a main lever 70, a sub-lever 71 and a torsion spring 72.

Figure 11:
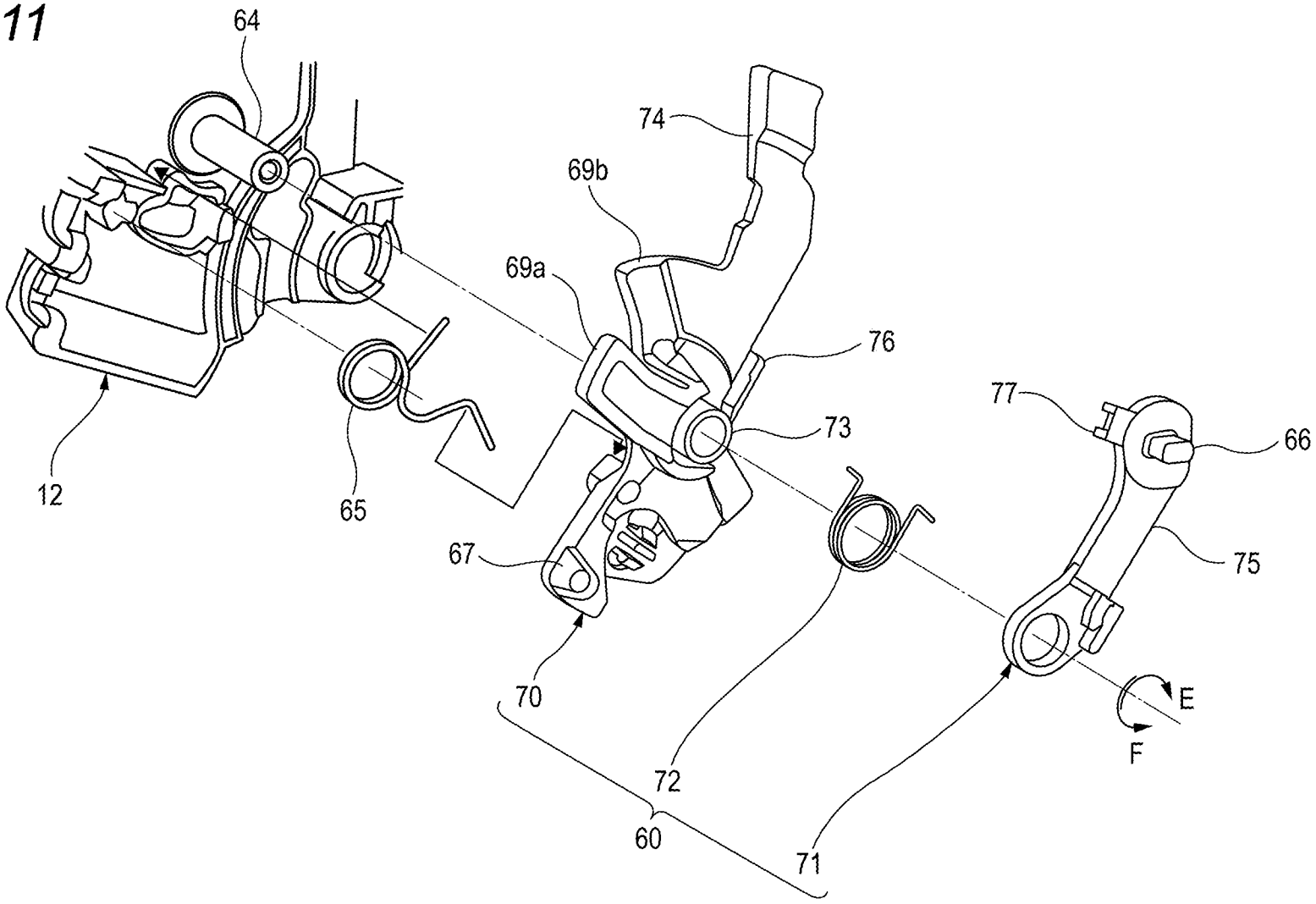
FIG. 11 is an exploded perspective view of a lock lever of the locking and unlocking mechanism shown in FIG. 4.

FIG. 11 shows the configuration of the lock lever 60.

A main lever 70 is supported rotatably by the lock lever shaft 64 on the case 12. Then, the main lever 70 has a sub-lever shaft 73, which is provided coaxially with the lock lever shaft 64, and a main arm 74 that extends from the sub-lever shaft 73.

The cable connecting portion 67 is provided on the main lever 70. The cable 16, which connects the lock knob 7 with the lock lever 60, is connected to the cable connecting portion 67. Additionally, the cam followers 69*a*, 69*b*, which are brought into engagement with the cams 68*a*, 68*b*, respectively, of the worm wheel 63, are also provided on the main lever 70. Consequently, the main lever 70 is rotated directly in a direction indicated by an arrow E in the figure towards an unlocking position or in a direction indicated by an arrow F in the figure towards a locking position based on an operation of the lock knob 7 or the control switch of the motor 61 to unlock or lock the vehicle door 1. Then, the main lever 70 is biased by the toggle spring 65 and is held in either of the unlocking position and the locking position.

The sub-lever 71 is supported rotatably by a sub-lever shaft 73 that is provided on the main lever 70. The sub-lever 71 has a sub-arm 75 that is superposed on the main arm 74. The engaging projection 66, which is brought into engagement with the engaging frame 42 of the opening member 40, is provided on the sub-arm 75.

The torsion spring 72 is wound circumferentially around the sub-lever shaft 73 between the main lever 70 and the sub-lever 71. One end of the torsion spring 72 is locked on the main lever 70, and the other end thereof is locked on the sub-lever 71. The torsion spring 72 biases the sub-lever 71 in the direction indicated by the arrow E relative to the main lever 70.

A stopper 76, which is configured to be brought into engagement with an edge of the sub-arm 75, is provided at a proximal end portion of the main arm 74. A stopper 77, which is configured to be brought into engagement with an edge of the main arm 74, is provided at a distal end portion of the sub-arm 75. A relative rotation between the main lever 70 and the sub-lever 71 to such an extent that the sub-arm 75 surpasses the main arm 74 in the direction indicated by the arrow E is restricted by the stopper 76 being brought into engagement with the sub-arm 75 and the stopper 77 being brought into engagement with the main arm 74, whereby the main lever 70 and the sub-lever 71 are normally rotated together in such a state that the main arm 74 is superposed on the sub-arm 75.

Figure 12:
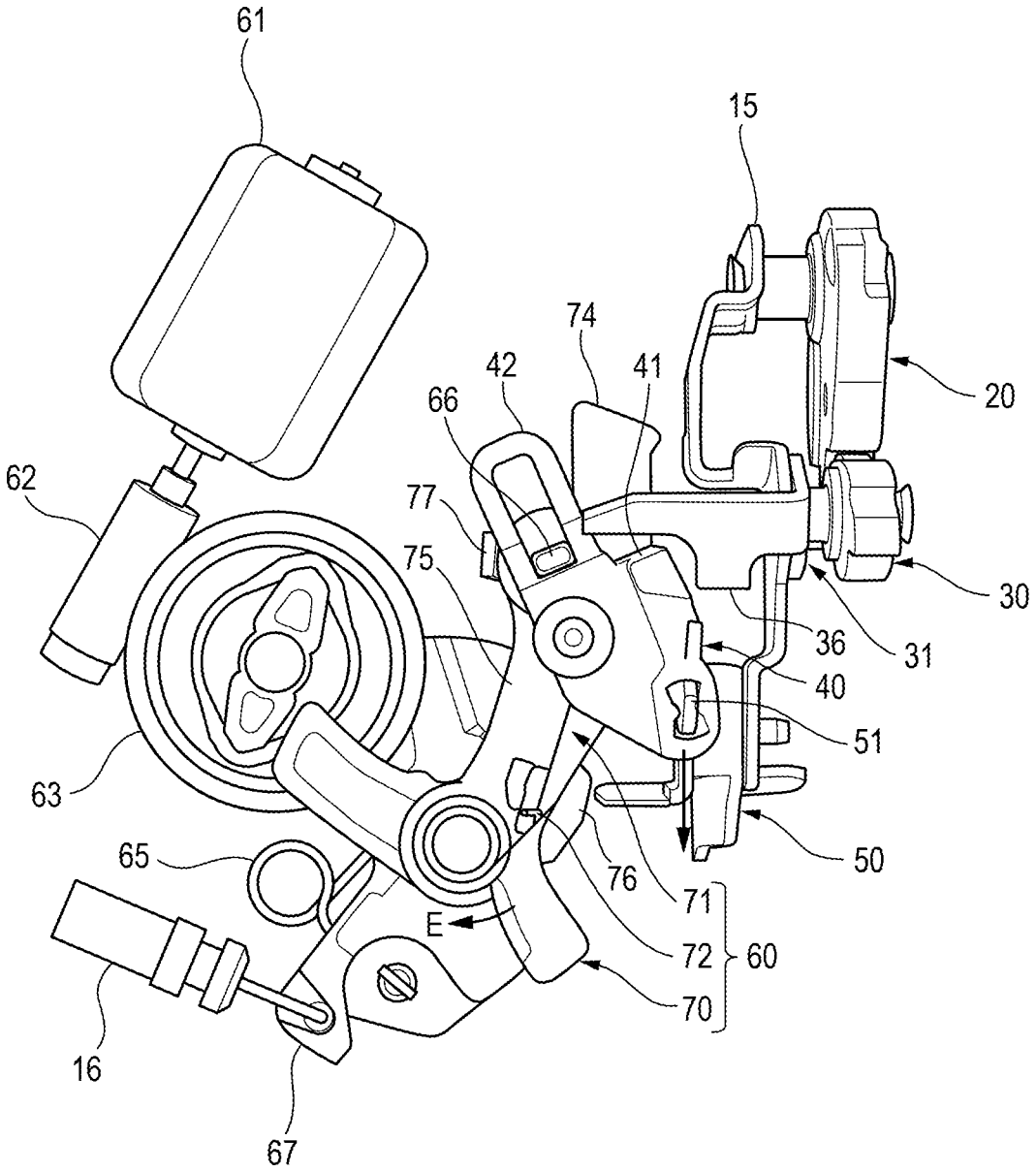
FIG. 12 is a schematic view showing an operation of the lock lever shown in FIG. 11.

FIG. 12 shows an operation of the lock lever 60 when the panic state is generated.

As shown in FIG. 12, in the panic state, the pressing portion 41 of the opening member 40 that swings idly is in abutment with the side portion of the pressed portion 36 of the ratchet lever 31. Since the engaging projection 66 of the sub-arm 75 is in engagement with the engaging frame 42 of the opening member 40, the sub-lever 71 is prevented from rotating in the direction indicated by the arrow E towards the unlocking position. On the other hand, the main lever 70 is rotated in the direction indicated by the arrow E to surpass a dead point where the toggle spring 65 reverses its biasing force while generating torsion in the torsion spring 72, whereby the main lever 70 is disposed in the unlocking position alone.

When the operation of the outside handle to open the vehicle door 1 is suspended once, allowing the opening member 40 to be moved downwards, the abutment of the pressing portion 41 with the side portion of the pressed portion 36 is released, whereby the sub-lever 71 is allowed to rotate in the direction indicated by the arrow E towards the unlocking position. As this occurs, the main lever 70 has already been in the unlocking position, and the sub-lever 71, which is biased by the torsion spring 72 so that the sub-arm 75 is superposed on the main arm 74 of the main lever 70 that is disposed in the unlocking position, is rotated in the direction indicated by the arrow E. This enables the sub-lever 71 to be disposed in the unlocking position by obviating the necessity of operating again the lock knob 7 to move the main lever 70 and the sub-lever 71 to the unlocking position.

Then, the opening member 40 is caused to oscillate in response to the rotation of the sub-lever 71, and the pressing portion 41 is disposed so as to be opposite to the lower portion of the pressed portion 36. Thereafter, the opening member 40 performs an unlatching operation in response to another operation of the outside handle to attempt to open the vehicle door 1, whereby the latch mechanism is switched from the latching state to the unlatching state.

The operation of the door lock apparatus 2 has been described heretofore which is triggered to be executed in a case where the outside handle is operated to open the vehicle door 1. Then, the door lock apparatus 2 will also operate basically in a similar manner when the inside handle 4 (refer to FIG. 1) is operated to open the vehicle door 1, in which case the opening member 40 executes an unlatching operation so as to switch the latch mechanism from the latching state to the unlatching state. However, the operation of the inside handle 4 to open the vehicle door 1 is transmitted to the opening member 40 by way of the inside lever and the child-proof mechanism. Hereinafter, the inside lever and the child-proof mechanism will be described.

Figure 13:
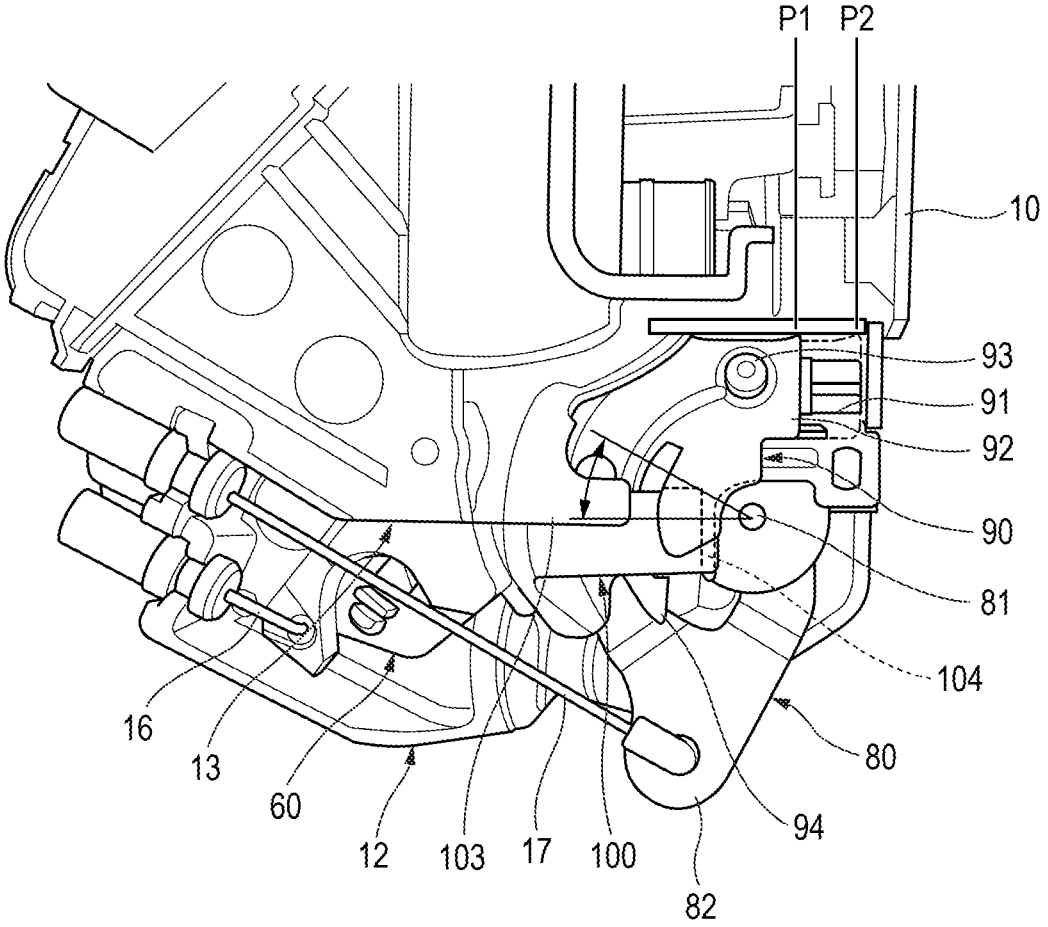
FIG. 13 is a front view showing an inside lever and a child-proof mechanism of the door lock apparatus shown in FIG. 3.
Figure 14:
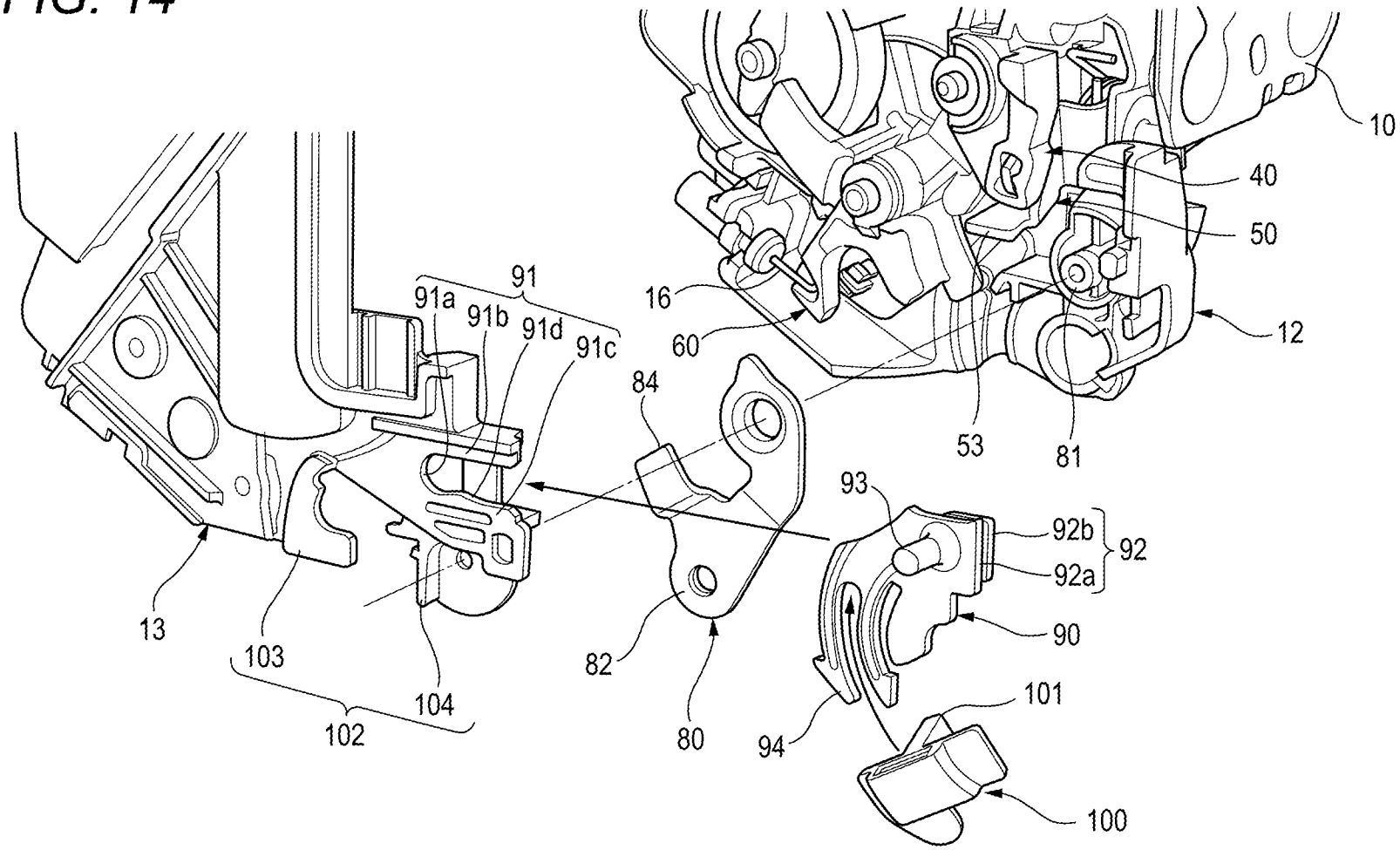
FIG. 14 is an exploded perspective view showing the inside lever and the child-proof mechanism shown in FIG. 13 as being disassembled from the door lock apparatus.

FIGS. 13 and 14 show the configurations of the inside lever and the child-proof mechanism.

An inside lever 80 is supported rotatably by an inside lever shaft 81 that is provided on the case 12. The inside lever 80 is connected to the inside handle 4 (refer to FIG. 1) by way of a cable 17 that is connected to a cable connecting portion 82 to thereby be rotated in response to an operation of the inside handle 4 to open the vehicle door 1.

The child-proof mechanism includes a child lever 90 and a bush 100 and can be switched, as described above, between the unset state where the opening member 40 is caused to unlatch the vehicle door 1 as the inside handle 4 is operated to open the vehicle door 1 and the set state where the opening member 40 is prevented from unlatching the vehicle door 1.

The child lever 90 is supported by a lever supporting portion 91 that is provided on the cover 13. The lever supporting portion 91 is made up of a guide groove 91*a* that extends in the front-rear direction of the vehicle on an upper side of the inside lever shaft 81 and groove edge portions 91*b*, 91*c* that lie opposite to each other across the guide groove 91*a*. A supported portion 92 of the child lever 90 that is supported by the lever supporting portion 91 has a pair of opposite pieces 92*a*, 92*b* that hold the groove edge portion 91*b*, 91*c* of the lever supporting portion 91 therebetween and a connecting piece that connects the pair of opposite pieces 92*a*, 92*b* together through the guide groove 91*a*.

The child lever 90 is guided so as to be translated in the direction in which the guide groove 91*a* of the lever supporting portion 91 extends by holding the groove edge portions 91*b*, 91*c* of the lever supporting portion 91 by the pair of opposite pieces 92*a*, 92*b* and allowing the connecting piece to slide along the groove edge portions 91*b*, 91*c*. Then, an elastic piece 91*d* that protrudes into the guide groove 91*a* is provided at a central portion of the groove edge portion 91*c*, and as a result of the connecting piece riding over the elastic piece 91*d*, the child lever 90 is held in either an unset position P1 that lies at one end side of the guide groove 91*a* or a set position P2 that lies at the other end side of the guide groove 91*a*.

The child lever 90 has further an operating portion 93 and a bush supporting portion 94.

The operating portion 93 is provided on the supported portion 92 and is exposed through the hole 8 (refer to FIG. 2) that is formed on the inner panel 5 of the vehicle door 1. The child lever 90 is translated between the unset position P1 and the set position P2 as the exposed operating portion 93 is operated.

The operating portion 93 (the child lever 90) is disposed closer to the cover plate 10 when the operating portion 93 (the child lever 90) is in the set position P2 than when the operating portion 93 (the child lever 90) is in the unset position P1. In other words, the operating portion 92 (the child lever 90) is then disposed closer to the door lock attaching surface 5*a* of the inner panel 5 to which the cover plate 10 is attached.

The safety of the operating portion 93 is enhanced and the operability thereof is improved as a result of the operating portion 93 being provided on the supported portion 92 that is supported directly by the lever supporting portion 91 of the cover 13.

The bush supporting portion 94 extends from the supported portion 92 into an arc-like shape and is disposed to a side of the inside lever shaft 81 with a space defined in the translating direction of the child lever 90 on an opposite side to the cover plate 10, that is, on an opposite side to the door lock attaching surface 5*a* of the inner panel 5 with the inside lever shaft 81 held therebetween in the translating direction. In a case where the child lever 90 is disposed in the unset position P1, a center axis of the bush supporting portion 94 coincides with the inside lever shaft 81.

The bush 100 is formed into a cylindrical shape, and the bush supporting portion 94 of the child lever 90 is passed through the bush 100. The bush 100 is supported by the bush supporting portion 94 so as to move along an arc-like track T1 that is regulated by the bush supporting portion 94 and is translated together with the child lever 90 as the child lever 90 is translated.

When the bush 100 is in the set position P2, the bush 100 is disposed between the bush 100 in the unset position P1 and the inside lever shaft 81 and is disposed closer to the inside lever shaft 81 than when the bush 100 is in the unset position P1.

Then, the inside lever 80 has a pressing portion 84 that presses against the bush 100. The outside lever 50 that supports the opening member 40 has a pressed portion 53 that is pressed by the bush 100. The bush 100 has a knock pin 101 that is brought into engagement with the pressing portion 84 and the pressed portion 53, and a rotation of the inside lever 80 is transmitted to the outside lever 50 by way of the bush 100.

The knock pin 101 is moved along a line that crosses an arc-like track T2 (refer to FIG. 15) of the pressing portion 84 in the translating direction as the child lever 90 and the bush 100 are translated. The knock pin 101 is disposed on the track T2 of the pressing portion 84 when the child lever 90 is disposed in the unset position P1. The knock pin 101 is disposed deviated from the track T2 of the pressing portion 84 when the child lever 90 is disposed in the set position P2.

FIGS. 15 and 16 and FIGS. 17 and 18 show operations of the child-proof mechanism.

Figure 15:
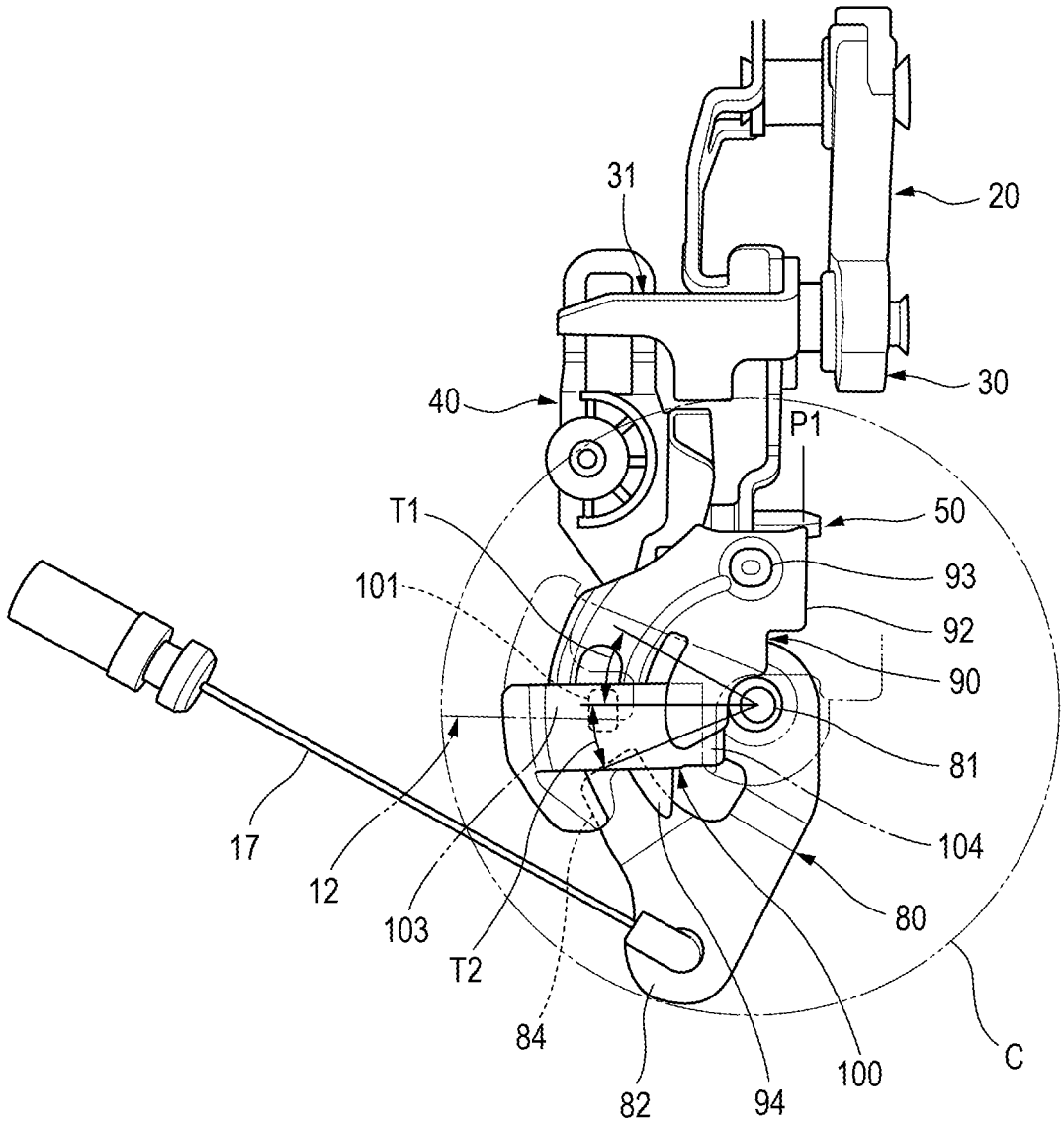
FIG. 15 is a schematic view showing an operation of the inside lever and the child-proof mechanism shown in FIG. 13.
Figure 16:
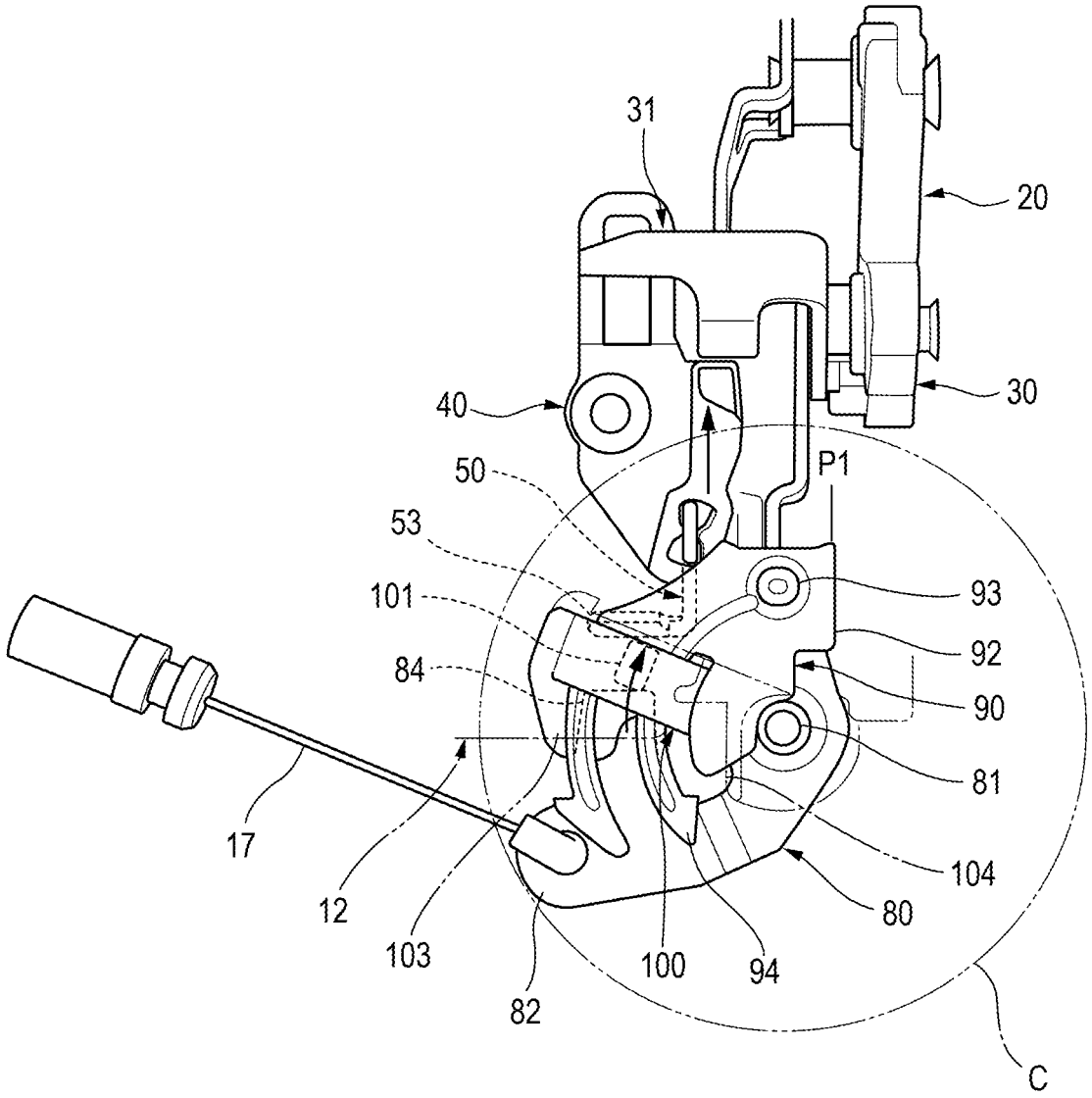
FIG. 16 is a schematic view showing another operation of the inside lever and the child-proof mechanism shown in FIG. 13.

FIGS. 15 and 16 show an operation of the child-proof mechanism that is in the unset state. Firstly, as shown in FIG. 15, the child lever 90 is disposed in the unset position P1, and the knock pin 101 of the bush 100 is disposed on the track T2 of the pressing portion 84 of the inside lever 80.

As shown in FIG. 16, when the inside lever 80 is rotated in response to an operation of the inside handle 4 to open the vehicle door 1, the pressing portion 84 is brought into engagement with the knock pin 101, whereby the bush 100 is pushed up along the track T1. Then, as a result of the bush 100 being pushed up along the track T1, the knock pin 101 is brought into engagement with the pressed portion 53 of the outside lever 50, whereby the outside lever 50 is rotated in the same way as when the outside handle is operated to open the vehicle door 1. This causes the opening member 40 to unlatch the vehicle door 1, and when the locking and unlocking mechanism is in the unlocking state, the latch mechanism is switched from the latching state to the unlatching state, whereas when the locking and unlocking mechanism is in the locking state, the latch mechanism is held in the latching state.

Here, when the child lever 90 is disposed in the unset position P1, the center axis of the arc-like bush supporting portion 94 coincides with the inside lever shaft 81. Consequently, the arc-like track T1 of the bush 100 that is regulated by the bush supporting portion 94 becomes concentric with the arc-like track T2 of the pressing portion 84. Due to the track T1 and the track T2 being concentric with each other, a moving direction of the bush 100 becomes parallel to a moving direction of the pressing portion 84, thereby making it possible to move the bush 100 smoothly.

In this illustrative embodiment, from the viewpoint of allowing the bush 100 to move smoothly, a bush guide portion 102 is provided on the cover 13 so as to guide a movement of the bush 100 along the track T1 (refer to FIGS. 14 and 15). The bush guide portion102 has a pair of guide walls 103, 104. The guide wall 104 is disposed on one side of the bush 100, and the guide wall 103 is disposed on an opposite side of the bush 100 in relation to the direction of a center axis of the track T1. The guide walls 103, 104 are both disposed so as to overlap the bush 100 along an overall moving range of the bush 100 when the bush 100 is moved along the track T1. The bush 100 is restrained from being inclined by the pair of guide walls 103, 104, thereby making it possible to allow the bush 100 to move more smoothly. Although the bush 100 can be restrained from being inclined by either of the guide walls 103, 104, it is preferable that the bush 100 is held by the pair of guide walls 103, 104 in the direction of the center axis of the track T1 as shown in the figure.

Figure 17:
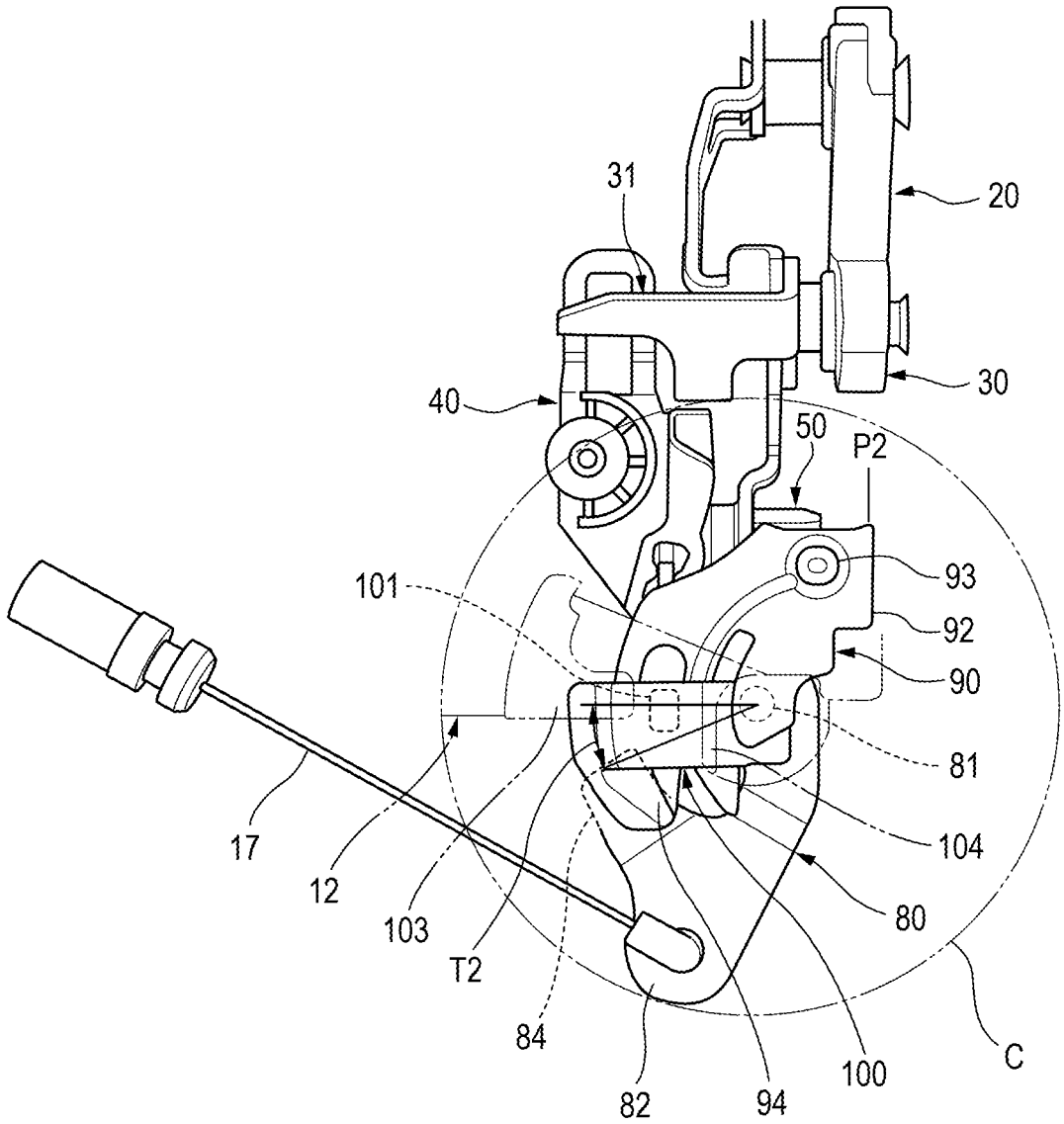
FIG. 17 is a schematic view showing a further operation of the inside lever and the child-proof mechanism shown in FIG. 13.
Figure 18:
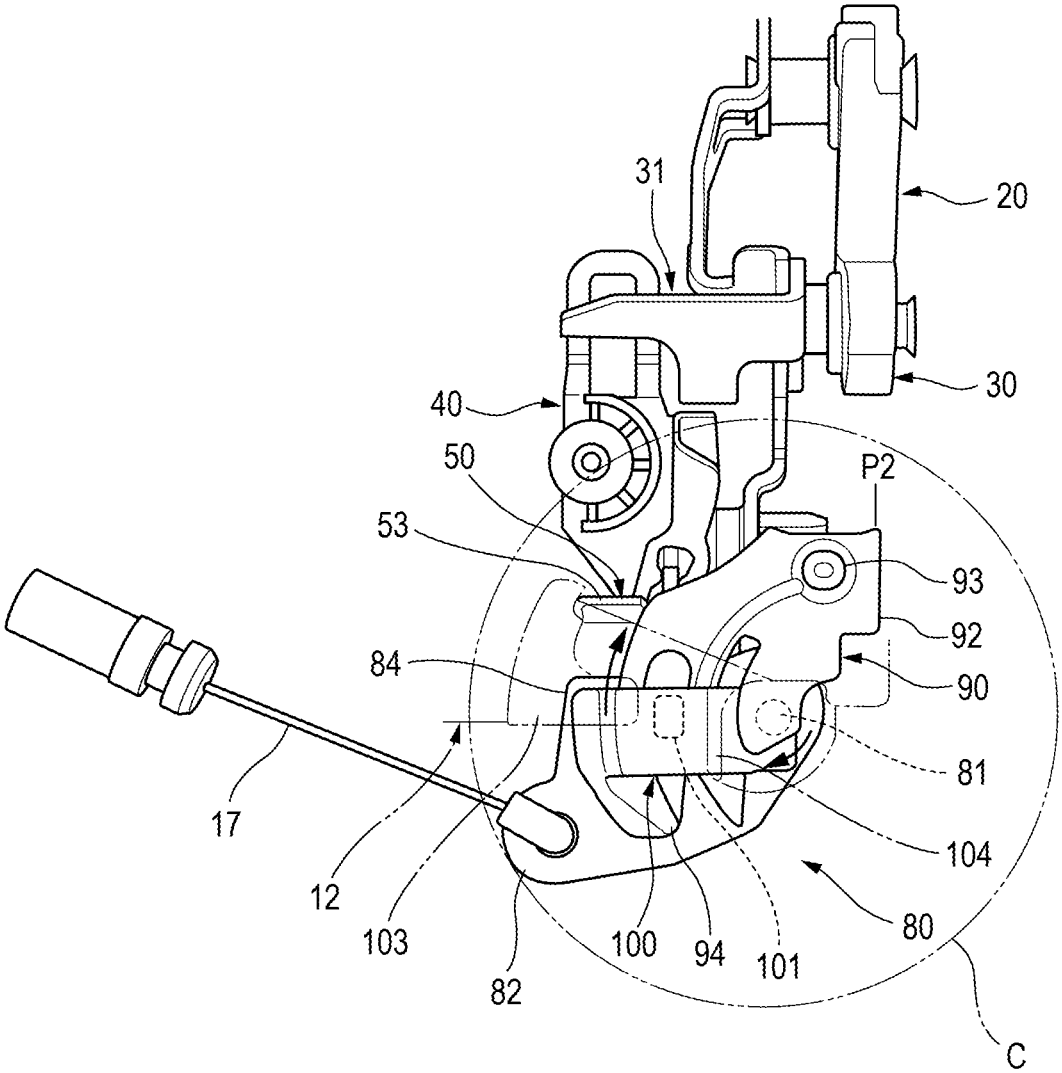
FIG. 18 is a schematic view showing an operation of the inside lever and the child-proof mechanism shown in FIG. 13.

FIGS. 17 and 18 show an operation of the child-proof mechanism that is disposed in the set state. Firstly, as shown in FIG. 17, the child lever 90 is disposed in the set position P2, and the knock pin 101 of the bush 100 is disposed out of alignment with the track T2 of the pressing portion 84 of the inside lever 80.

As shown in FIG. 18, even though the inside lever 80 is rotated in response to an operation of the inside handle 4 to open the vehicle door 1, since the knock pin 101 is out of alignment with the track T2 of the pressing portion 84, the pressing portion 84 is not brought into engagement with the knock pin 101, and hence, there is no such situation that the bush 100 is pushed up along the track T1. Consequently, the knock pin 101 is not brought into engagement with the pressed portion 53 of the outside lever 50, and hence, there is no such situation that the outside lever 50 is rotated. As a result, the opening member 40 is prevented from unlatching the vehicle door 1, and hence, even in a case where the locking and unlocking mechanism is in the unlocking state, the latch mechanism is held in the latching state.

In the operations of the child-proof mechanism that have been described heretofore, with the child-proof mechanism disposed in the unset state shown in FIGS. 15 and 16, the child lever 90 disposed in the unset position P1 stays inside a circle C that is centered at the inside lever shaft 81 and whose radius corresponds to a distance from the inside lever shaft 81 to the cable connecting portion 82 that constitutes a farthest point of the inside lever 80, and the bush 100 is also moved inside the circle C.

Then, as described above, the bush supporting portion 94 of the child lever 90 and the bush 100 that is supported on the bush supporting portion are disposed to the side of the inside lever shaft 81 on the opposite side to the door lock attaching surface 5*a* of the inner panel 5 across the inside lever shaft 81, and the child lever 90 is translated from the unset position P1 to the door lock attaching surface 5*a* of the inner panel 5 towards the set position P2.

Consequently, with the child-proof mechanism disposed in the set state shown in FIGS. 17 and 18, the bush supporting portion 94 of the child lever 90 that is disposed in the set position P2 and the bush 100 that is supported on the bush supporting portion 94 are disposed between the bush supporting portion 94 and the bush 100 that result when the child-proof mechanism is disposed in the unset state and the inside lever shaft 81 and is disposed closer to the inside lever shaft 81 than the bush supporting portion 94 and the bush 100 that result when the child-proof mechanism is disposed in the unset state. Due to this, the child lever 90 and the bush 100 are also disposed inside the circle C even when the child-proof mechanism is in the set state.

In this way, the child-proof mechanism becomes small in size and light in weight as a result of the child lever 90 and the bush 100 being confined within the circle C, thereby making it possible to make the door lock apparatus 2 small in size and light in weight.

What is claimed is:

1. A door lock apparatus comprising:

a latch mechanism configured to be switched between a latching state, in which the latch mechanism is brought into engagement with a striker provided on a vehicle body to hold a vehicle door in a closed state, and an unlatching state;

an inside lever configured to be rotated in response to an operation of an inside handle of the vehicle door to open the vehicle door from the closed state;

an opening member configured to switch the latch mechanism to the unlatching state by being actuated by a rotation of the inside lever to switch the latch mechanism to the unlatching state;

a child lever comprising an operating portion that is exposed through a hole formed in a panel of the vehicle door, the child lever being configured to be translated between a set position and an unset position in response to an operation of the operating portion; and a bush configured to be translated integrally with the child lever between the set position and the unset position, the bush is brought into engagement with the inside lever when the child lever is disposed in the unset position such that the rotation of the inside lever causes movement of the bush relative to the child lever, thereby transmitting the rotation of the inside lever to the opening member, the bush is released from the engagement with the inside lever when the child lever is disposed in the set position, wherein, in the set position and in the unset position, the child lever and the bush are positioned completely inside a circle that is centered at a rotation shaft of the inside lever and whose radius corresponds to a distance from the rotation shaft to a farthest reaching point of the inside lever.

2. The door lock apparatus according to claim 1, wherein the child lever, when disposed in the set position, is disposed closer to an end face of the panel where a cutout is formed, than when the child lever is disposed in the unset position, the cutout extending in a direction in which the striker enters the latch mechanism, and wherein the bush, when the child lever is disposed in the set position, is disposed closer to the rotation shaft of the inside lever, than when the child lever is disposed in the unset position.

3. The door lock apparatus according to claim 1, further comprising:

a cover comprising a lever supporting portion that supports the child lever such that the child lever is translatable between the set position and the unset position, wherein the child lever comprises a supported portion that is supported on the lever supporting portion, and wherein the operating portion is provided on the supported portion.

4. The door lock apparatus according to claim 3, wherein the bush is supported on the child lever so as to be movable relative to the child lever along an arc-shaped track that becomes concentric with the rotation shaft of the inside lever when the child lever is disposed in the unset position, the bush being movable along the arc-shaped track by the inside lever when brought into engagement with the inside lever during the rotation of the inside lever, wherein the cover further comprises a bush guide portion that is configured to guide the bush, and wherein the bush guide portion comprises a guide wall, which overlaps at least one side of the bush in relation to a direction of a center axis of the arc-shaped track, and which overlaps over an overall rotational range of the bush when the child lever is disposed in the unset position and the bush moves along the arc-shaped track by the inside lever when brought into engagement with the inside lever during the rotation of the inside lever.

5. The door lock apparatus according to claim 1, wherein the inside lever comprises a pressing portion that is movable along an arc-shaped track in accordance with the rotation of the inside lever, the arc-shaped track being concentric with the rotation shaft of the inside lever, and wherein the bush comprises a pin that is disposable between a first position and a second position in accordance with the integral translation of the bush with the child lever, the first position being on the arc-shaped track and the second position being deviated from the arc-shaped track.

6. The door lock apparatus according to claim 5, wherein, when the child lever is disposed in the unset position and the pin is disposed in the first position, the pressing portion is configured to brought into engagement with the pin in accordance with the rotation of the inside lever, and wherein, when the child lever is disposed in the set position and the pin is disposed in the second position, the pressing portion is configured not to be brought into engagement with the pin regardless of the rotation of the inside lever.

7. The door lock apparatus according to claim 1, wherein the bush is supported on the child lever so as to be movable relative to the child lever along a first arc-shaped track, wherein the inside lever comprises a pressing portion that is movable along a second arc-shaped track in accordance with the rotation of the inside lever, the second arc-shaped track being concentric with the rotation shaft of the inside lever, and wherein when the child lever is disposed in the unset position, the first arc-shaped track becomes concentric with the second arc-shaped track, and a moving direction of the bush becomes parallel to a moving direction of the pressing portion.

8. A door lock apparatus comprising:

a latch mechanism configured to be switched between a latching state, in which the latch mechanism is brought into engagement with a striker provided on a vehicle body to hold a vehicle door in a closed state, and an unlatching state;

an inside lever configured to be rotated in response to an operation of an inside handle of the vehicle door to open the vehicle door from the closed state;

an opening member configured to switch the latch mechanism to the unlatching state by receiving the rotation of the inside lever in response to the operation of the inside handle to open the vehicle door;

a child lever comprising:

an operating portion that is exposed through a hole formed in a panel of the vehicle door, the child lever being configured to be translated between a set position and an unset position in response to an operation of the operating portion; and a bush configured to be translated integrally with the child lever between the set position and the unset position, the bush is brought into engagement with the inside lever when the child lever is disposed in the unset position such that the rotation of the inside lever causes movement of the bush relative to the child lever, thereby transmitting the rotation of the inside lever to the opening member, the bush is released from the engagement with the inside lever when the child lever is disposed in the set position, wherein, as the child lever moves between the set position and the unset position, a movable range of the child lever, a movable range of the bush relative to the child lever, and the operating portion are confined inside a circle that is centered at a rotation shaft of the inside lever and whose radius corresponds to a distance from the rotation shaft to a farthest reaching point of the inside lever.

9. The door lock apparatus according to claim 8, wherein the child lever further comprises a supporting portion having a groove, one end of the groove being opened to form an inlet, the groove having an arc shape that is concentric with the rotation shaft of the inside lever when the child lever is disposed in the unset position, and wherein the bush comprises a knock pin that protrudes in a same direction that the rotation shaft of the inside lever protrudes, the knock pin being insertable into the groove through the inlet of the groove during assembly of the bush to the child lever, the bush being translated along the groove through the movable range of the bush relative to the child lever.

* * * * *